United States Patent [19]

Hasegawa et al.

[11] Patent Number: 5,074,204

[45] Date of Patent: Dec. 24, 1991

[54] USED MASTER DISPOSING APPARATUS

[75] Inventors: Takanori Hasegawa, Hachiohji; Takahiro Furuyama, Ushiku; Yoshikazu Hara, Inashiki, all of Japan

[73] Assignee: Riso Kagaku Corporation, Tokyo, Japan

[21] Appl. No.: 498,577

[22] Filed: Mar. 26, 1990

[30] Foreign Application Priority Data

Mar. 27, 1989 [JP] Japan ..... 1-71871

[51] Int. Cl.[5] ..... B30B 15/14; B30B 1/24

[52] U.S. Cl. ..... 100/49; 100/50; 100/52; 100/53; 100/99; 100/211; 100/229 A; 100/99, 211, 229 A, 256, 295, 233, 288

[58] Field of Search ..... 100/45, 48-53, 100/99, 211, 229 A, 255, 295, 233, 288

[56] References Cited

U.S. PATENT DOCUMENTS

| | | | |
|---|---|---|---|
| 2,790,478 | 4/1957 | Shapiro | 100/50 X |
| 3,046,872 | 7/1962 | Pease, III | 100/52 |
| 3,527,161 | 9/1970 | Brown et al. | 100/52 X |
| 3,537,390 | 11/1970 | Hinkel et al. | 100/52 X |
| 3,543,676 | 12/1970 | Brown | 100/52 |
| 3,822,638 | 7/1974 | Merkin | 100/52 |
| 3,901,139 | 8/1975 | Moriconi | 100/52 X |
| 3,916,782 | 11/1975 | Booton | 100/50 X |
| 3,918,359 | 11/1975 | Hennells et al. | 100/52 |
| 4,188,872 | 2/1980 | Chrablow | 100/295 X |
| 4,735,136 | 4/1988 | Lee et al. | 100/52 |

*Primary Examiner*—Timothy F. Simone
*Assistant Examiner*—Stephen F. Gerrity
*Attorney, Agent, or Firm*—Kanesaka and Takeuchi

[57] ABSTRACT

A used master disposing apparatus comprises a receptacle for receiving a discharged master, a pressing member vertically movably mounted in the receptacle, and a device for vertically moving said pressing member. The pressing member compresses the master when the pressing member is lowered. The pressing member has a pressing surface, an area of which decreases when it is raised.

6 Claims, 11 Drawing Sheets

USED MASTER DISPOSING APPARATUS

BACKGROUND OF THE INVENTION

1. Field of the Invention

This invention relates to a used master disposing apparatus for compressing a used sheet-like master to discard it, and more particularly to a used master disposing apparatus in which a used mimeographic stencil discharged from a mimeographic printing machine is compressed and discarded.

2. Description of the Related Art

FIG. 15 of the accompanying drawings is a perspective view showing a used stencil discharging apparatus of a mimeographic printing machine. In FIG. 15, reference numeral 1 designates a receptacle box for receiving used stencils, the receptacle box 1 having at the front an inlet 2 and at one side an outlet 3.

A drive shaft 5 supporting a plurality of gears 4, and rubber rollers 6 are disposed at the inlet 2 of the receptacle box 1 in parallel relation to the axis of a non-illustrated master drum. The respective gears 4 and the respective rubber rollers 6 are in engagement with each other; a used stencil S removed from the master drum is thereby brought into the receptacle box 1 as the drive shaft 5 is driven for counterclockwise rotation in FIG. 15 by a non-illustrated motor.

At the outlet 3 of the receptacle box 1, coacting metallic and rubber rollers 7, 8 are disposed in parallel relation to the axis of the master drum. The metallic roller 7 and the rubber roller 8 coact to discharge the stencil from the receptacle box 1.

On the bottom of the receptacle box 1, a plurality of metallic follower feed rollers 10 is arranged at small distances in parallel relation to the metallic and rubber rollers 7, 8. Each follower feed roller 10 is rotatable about its shaft 11.

A drive feed roller 14 is rotatably supported on the top (ceiling) of the receptacle by a shaft 13 parallel to the shaft 11, and is driven in clockwise direction by a non-illustrated motor. The drive feed roller 14 has a semicylindrical contour. The semicylindrical peripheral surface is covered with an elastic member 15 which is elastic like a sponge or formed of a synthetic resin and has a high coefficient in friction. The drive feed roller 14, in the illustrated conventional example, has a central gap 16 dividing the semicylindrical roller in two halves axially. The ceiling wall of the receptacle box 1 has a pair of openings 17, 17 receptive of the divided drive feed roller 14, leaving a bridge 18 between the two openings 17, 17 to prevent the stencil from being wound around the peripheral surface of the drive feed roller 14.

There is defined in the receptacle box 1 between the drive feed roller 14 and the follower feed roller 10 a gap receptive of the stencil when the omitted half of the drive feed roller 14 is located in a position confronting the follower feed roller 10. To the contrary, the other half, i.e. the elastic member 15 of the drive feed roller 14 comes in pressing engagement with the follower feed roller 10 when the elastic member 15 of the drive feed roller 14 faces the roller 10.

A disposal box 19 extends downwardly from and communicates with the outlet 3.

With the foregoing arrangement, the stencil S removed from the non-illustrated master drum is discharged into the receptacle box 1 by the gears 4 and the rubber rollers 6. The stencil S discharged in the receptacle box 1 assumes a folded posture longitudinally bent in a wavy shape as its movement is restricted by the wall surfaces of the receptacle 1. At that time, since the omitted half of the drive feed roller 14 faces the follower feed roller 10 to define therebetween a space for receiving the stencil S, the stencil S is discharged into the receptacle box 1 without interference by the drive feed roller 14. In the meantime, a part of the stencil S is inserted between the follower feed roller 10 and the drive feed roller 14.

When the entire stencil S has been discharged in the receptacle box 1, the drive feed roller 14 is driven in the clockwise direction in FIG. 15 so that the elastic member 15 of the drive feed roller 14 can be rotated to engage the follower feed roller 10. As the stencil S is compressed between the follower feed roller 10 and the drive feed roller 14, the stencil S is longitudinally folded and is conveyed in the receptacle box 1 toward the outlet 3 by the frictional resistance with the elastic member 15. The stencil S having been folded by compressing is relatively hard and is sandwiched between the metallic and rubber rollers 7, 8 and is thus discharged from the output 3 into the disposal box 19.

Although the stencil or master discharged in the disposal box 19 by the stencil discharging apparatus assumes a folded posture, it is considerably bulky. Consequently it is impossible to accommodate a large quantity of used masters in the disposal box 19 by merely dropping thereinto so that the disposal box 19 would be soon filled with the stencils.

When the receptacle box filled with the stencils is removed from the apparatus, the stencils in the receptacle box become bulky due to their restoration as the top of the stencil stack is freed upon removal of the receptacle box, causing some upper stencils to overflow from the receptacle box.

SUMMARY OF THE INVENTION

It is therefore an object of this invention to provide a used master disposing apparatus in which a large quantity of used masters can be received in a receptacle.

Another object of the invention is to provide a used master disposing apparatus in which even when a receptacle fully filled with discharged used masters is removed from the apparatus, any of the used masters is prevented from falling from the receptacle.

According to a first aspect of this invention, there is provided a used master processing apparatus comprising: a receptacle for receiving a discharged master; a pressing member vertically movably mounted in said receptacle, said pressing member being adapted to compress the master when said pressing member is lowered, said pressing member having a pressing surface area of which decreases when it is raised; and means for vertically moving said pressing member.

According to a second aspect of the invention, there is provided a used master processing apparatus comprising: a receptacle for receiving a discharged master; a pressing member vertically movably mounted in said receptacle, said pressing member being adapted to compress the master when said pressing member is lowered; a detecting means for detecting whether said receptacle is filled with the masters; and a control means for driving said pressing member, upon receipt of a detection signal from said detecting means, in such a manner that said pressing member compresses the master in said receptacle for a predetermined period of time.

DETAILED DESCRIPTION

A first embodiment of this invention will now be described with reference to FIGS. 1 through 9.

A master disposing apparatus of the first embodiment is to be incorporated in a mimeographic printing machine and is particularly useful when used in compressing a used master or stencil discharged from a master discharging unit of the mimeographic printing machine and discarding the master as compressed in compact size. The construction of the master discharging unit is virtually identical with that of the conventional discharging unit discussed above, and its description is omitted here for clarity.

Figure 1:
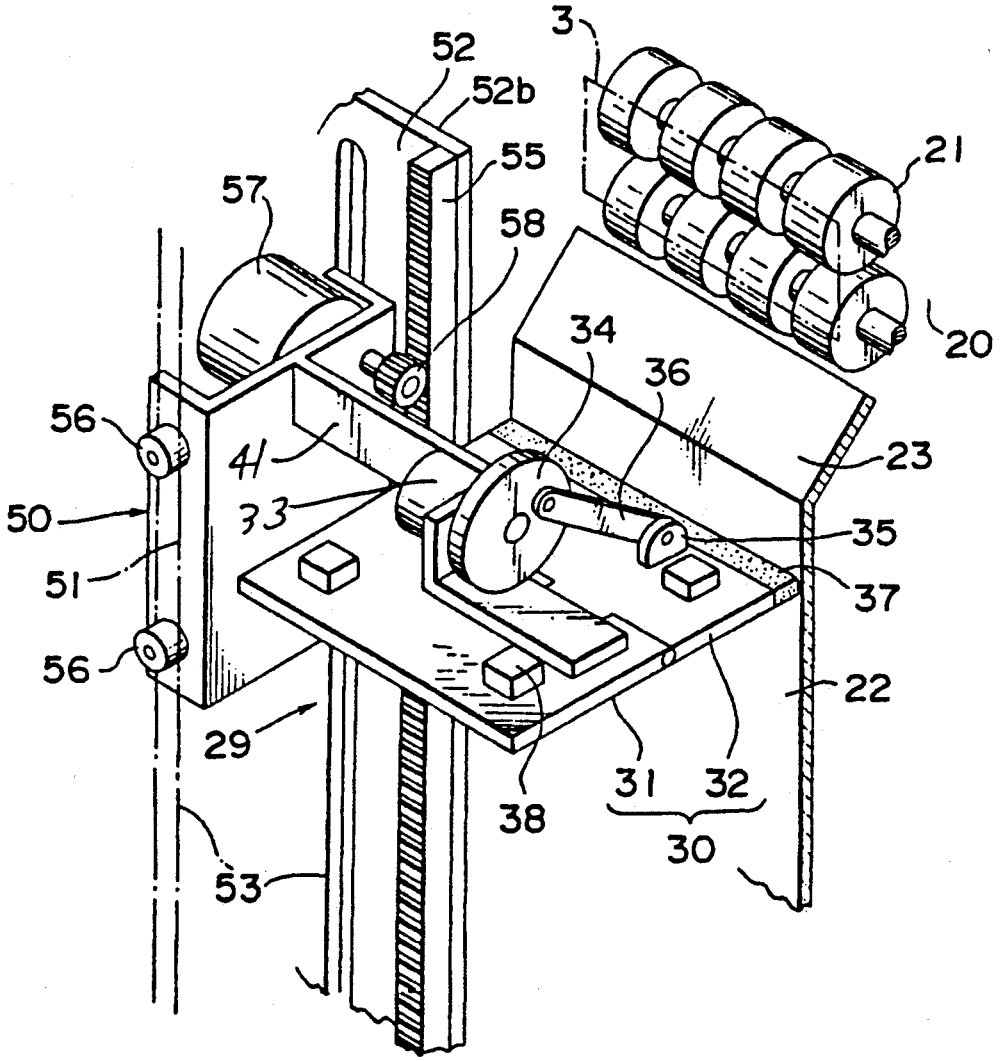
FIG. 1 is a fragmentary perspective view of a used master disposing apparatus according to a first embodiment of this invention.
Figure 3:
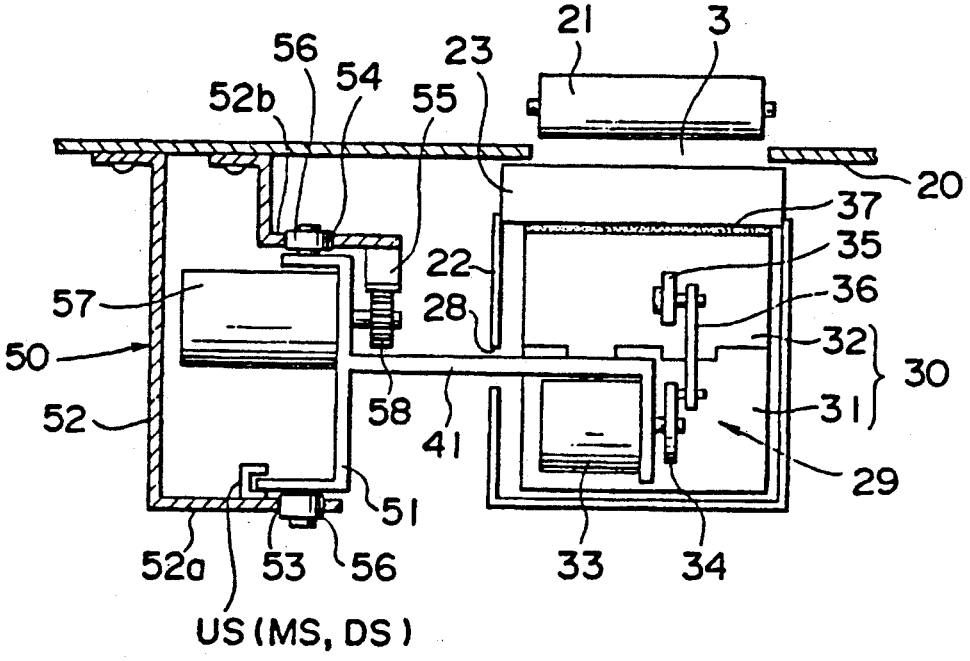
FIG. 3 is a plan view, partially in cross section, of the apparatus.
Figure 4:
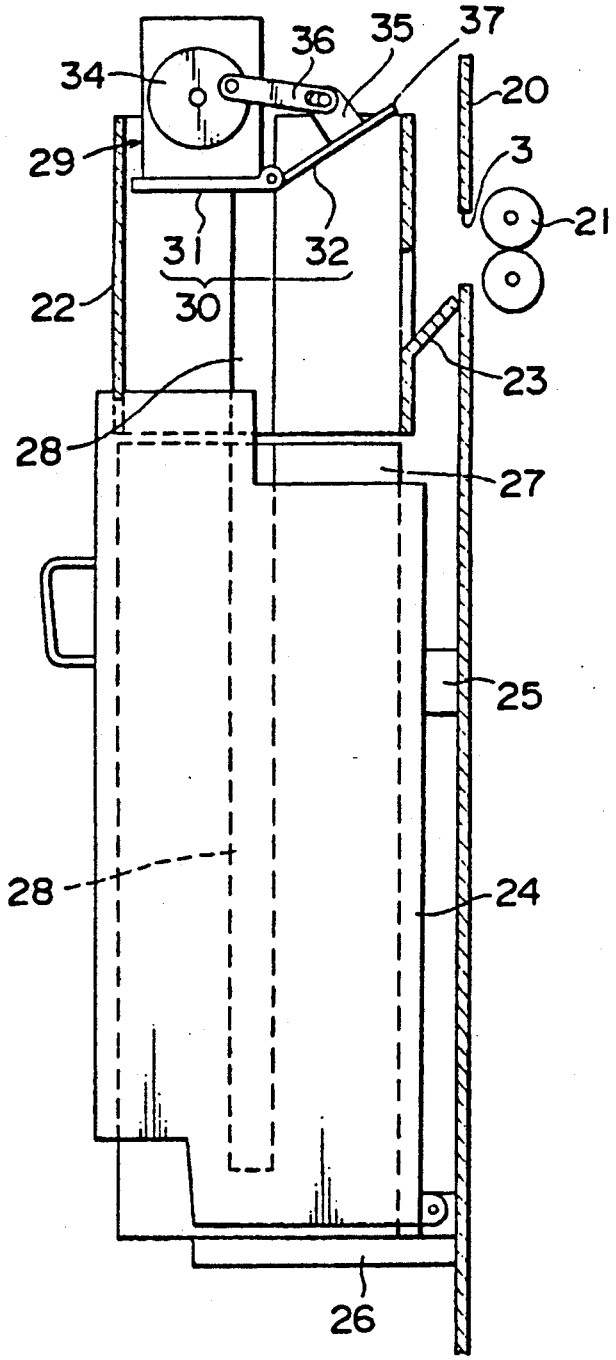
FIG. 4 is a side elevational view, partially in cross section, of the apparatus.

As shown in FIGS. 1, 3 and 4, a frame 20 of the mimeographic printing machine has an outlet 3 for the master, and a pair of feed rollers 21 is mounted at the inner side of the frame 20 in confronting relation to the output 3. At the outer surface of the frame 20, a duct 22 as one of a receptacle is disposed and communicates with the outlet 3 via a guide plate 23. The duct 22 has upper and lower open end portions each in the form of a rectangular tube, under which a master box 24 as another receptacle is disposed and communicates with the duct 22. The master box 24 also has upper and lower end portions each in the form of a substantially rectangular tube, and is pivotally connected at the lower end to the frame 20 and is detachably attached to the frame 20 by a magnet as a securing means mounted on a rear surface of the box. The lower open end portion of the master box 24 is covered by a bottom plate 26 attached to the frame 20. Inside the master box 24, a paper box 27 as a discarding receptacle having a substantially identical shape with the master box 24 is accommodated, which is supported on the bottom plate 26. A vertical slit 28 extends in one side wall of each of the duct 22, the master box 24 and the paper box 27.

Further, inside the duct 22 and the master box 24, a pressing member 29 is vertically movably mounted for compressing a discarded master discarded in the paper box 27. The pressing member 29 includes a closure plate 30 composed of a vertically movable plate 31 and a pivotally movable plate 32, both having substantially the same shape and hinged on each other and serving as a pressing means. The shape of the closure plate 30 is a square corresponding to the inside shape of the duct 22 and the paper box 27. A motor 33 is supported on the top surface of the vertically movable plate 31, and a circular disk 34 is mounted on the drive shaft of the motor 33. A bracket 35 is attached to the top surface of the pivotally movable plate 32. The disk 34 is operatively connected at its side to the bracket 35 by a pin-connection link 36. Thus, by the drive of the motor 33, the pivotally movable plate 32 is pivotally moved upwardly from a horizontal position of FIG. 1.

Figure 5A:
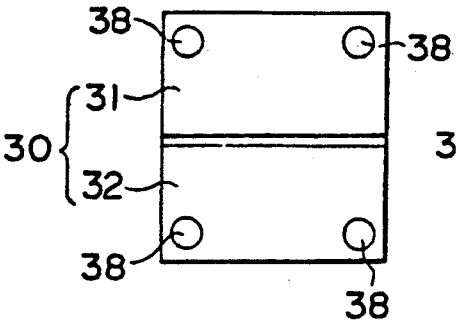
FIGS. 5(*a*) and 5(*b*) each show a different pressure detection means mounted on a closure plate of the apparatus.
Figure 5B:
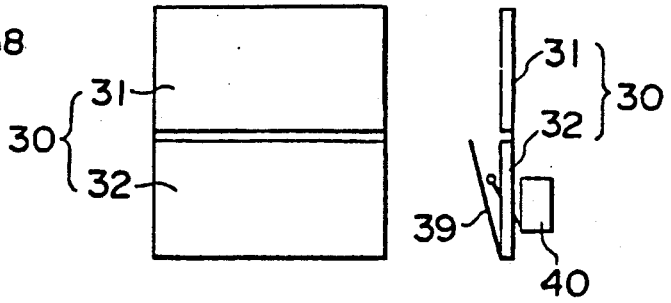

Reference numeral 37 in FIGS. 1, 3 and 4 designates a sponge as a sealing member disposed against the inner surface of the duct 22 and the paper box 27. As shown in FIG. 5(*a*), a pressure sensor 38 is mounted on each of four corners of the closure plate 30 and serves as a detecting means for detecting whether the receptacle is filled with the discharged masters, namely, for detecting the pressure when the discharged master is compressed. Alternatively, as shown in FIG. 5(B), instead of the pressure sensor 38, a resilient member 39 may be mounted on the rear side of the closure plate 30, and a pressure switch 40 operable by the resilient member 39 may be mounted on the front side of the closure plate 30. The vertically movable plate 31 of the closure plate 30 is operatively connected to a vertically moving means 50 via a connecting plate 41 which is inserted in the slits 28 of the duct 22, the discharged master box 24 and the paper box 27.

Figure 2:
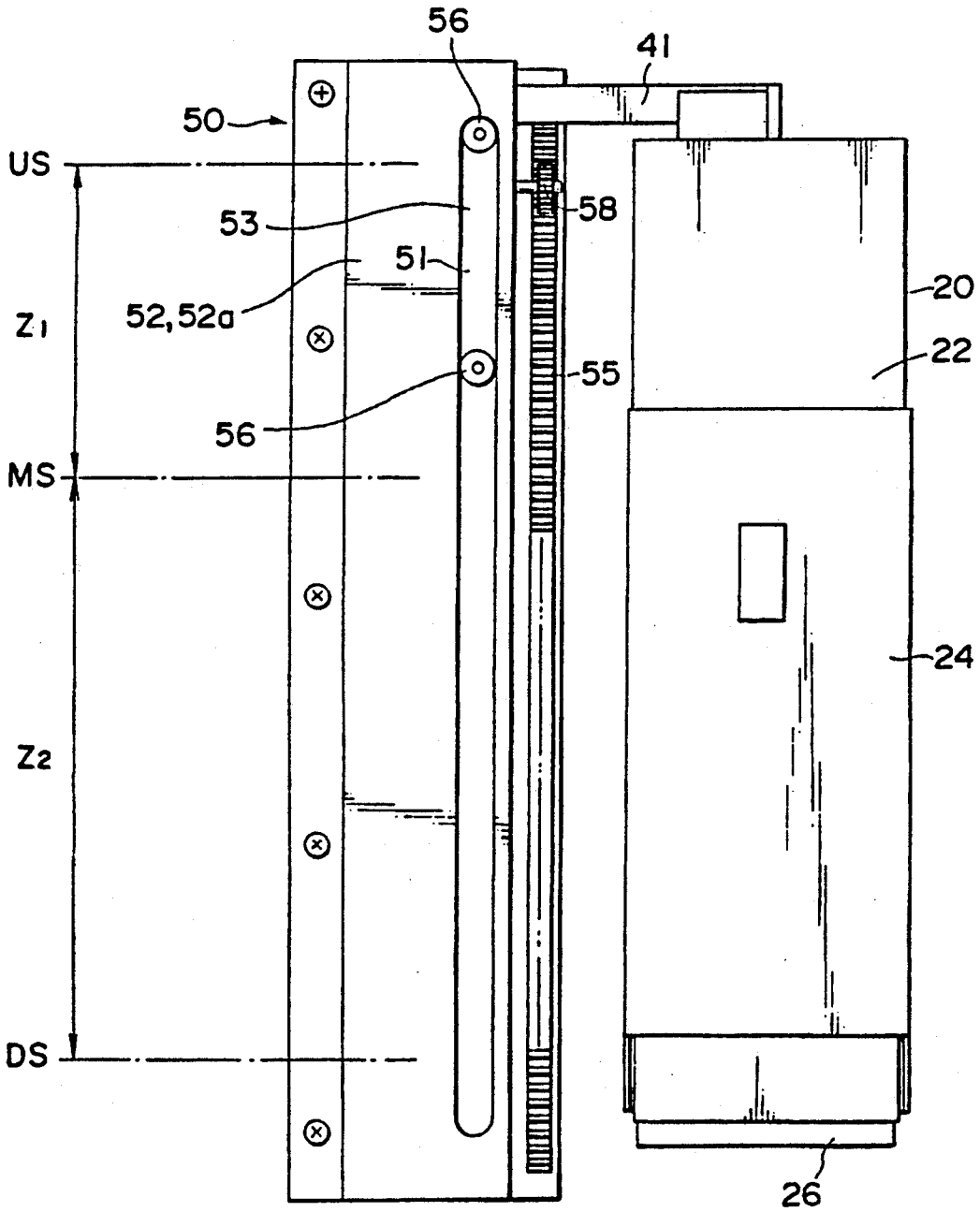
FIG. 2 is a front elevational view of the apparatus.

The vertically moving means 50 includes a vertically movable member 51 connected to the closure plate 30, and a guide case 52 for vertically guiding the vertically movable member 51. As shown in FIGS. 1 to 3, the guide case 52 is disposed on the slit side of the duct 22 and is attached to the frame 20 of the mimeographic printing machine. The guide case 52 has in its front and rear plates 52*a*, 52*b* a pair of vertical guide slits 53, 54, respectively. A rack 55 is mounted on the rear plate 52*b* and is disposed adjacent to the guide slit 54 in parallel relation to the guide slits 53, 54.

Further, the vertically movable member 51 is received in the guide case 52 for vertical movement. A pair of bearing members 56, 56 is mounted on the opposite sides of the vertically movable member 51. The two pairs of bearing members 56, 56; 56, 56 are rotatably engaged in the guide slits 53, 54, respectively. A motor 57 is mounted on the vertically movable member 51; a pinion 58 is mounted on the drive shaft of the motor 57 and is in meshing engagement with the rack 55. Thus, by the drive of the motor 57, the vertically movable member 51 is movable vertically as guided by the guide slits 53, 54 of the guide case 52.

Between the upper and lower portions of the guide case 52 of FIG. 2, there are disposed three position detecting switches US, MS, DS for detecting the position of the vertically movable member 51, thus serving as a means for detecting whether the receptacle has been fully filled with the used masters. Signals from the individual switches US, MS, DS and signals from the pressure sensors 38 mounted on the closure plate 30 are inputted to a control unit described below. This control unit controls the vertical movement of the vertically movable member 51 based on these data as well as operating commands from the outside.

Specifically, in this embodiment, if the pressure sensors 38 detect a predetermined pressure upon lowering of the pressing member 29 after an ON signal from the intermediate position detecting switch MS is inputted to the control unit, the control unit judges that a scheduled compressing work has been completed, and stops lowering the pressing member 29 and then raises the pressing member 29 to a standby position at the upper portion in duct 22, namely, until the upper position detecting switch US detects the pressing member 29. If the pressure sensors 38 detect a predetermined pressure earlier than a signal from the intermediate position detecting switch MS when the pressing member 29 is lowered, the control unit judges that the paper box 27 has been fully filled with the used masters, and then converts the movement of the pressing member 29 to upward movement. Concurrently with this, the control unit renders a display in an operation panel to show the message that the paper box 27 has been full with the used masters. The control unit also renders the pressing member 29 to complete the compressing of the used masters by repeating the foregoing compressing procedures for a predetermined times.

The lower position detecting switch DS serves to detect the lower limit when the amount of the discharged masters is small; upon receipt of a signal from this switch DS, the control unit converts the movement of the pressing member 29 to upward movement, even in the absence of any signal from the pressure sensor 38.

The signal from the intermediate position detecting switch MS is ignored while the pressing member 29 is being raised. In other words, the intermediate switch MS outputs an ON signal when the pressing member 29 is moved past the intermediate switch MS during lowering; but during upward movement of the pressing member 29, the intermediate switch MS assumes the OFF state. During lowering, the pressing member 29 is controlled so as to be shifted to the normal compressing, provided that the ON signal from the intermediate switch MS is inputted earlier than the signal from the pressure sensors 38.

By these position detecting switches US, MS, DS and the pressure sensors 38, the section between the upper switch US and the intermediate switch MS is defined as a standby-convey section $Z_1$, and the section between the intermediate switch MS and the lower switch DS is defined as a compression-accommodation section $Z_2$.

In operation, the pressing member 29 is located in a standby position disposed in the upper portion of the duct 22. As the used mimeographic master or stencil (used master) is discharged from the feed rollers into the duct 22, the vertically movable member 51 starts lowering by the drive of the motor 57 so that the pressing member 29 connected to the vertically movable member 51 starts lowering in the duct 22. At that time the pivotally movable plate 32 and the vertically movable plate 31 are disposed in a common plane. Thus, the closure plate 30 is maximal in area, and reliably compresses the used master by its entire surface to force the compressed master downwardly in the paper box 27.

When compressing takes place at a predetermined suitable pressure and when the predetermined pressure is detected by the pressure sensors 38 in the compression-accommodation section $Z_2$, the movement of the vertically movable member 51 is converted from downward movement to upward movement to set the pressing member 29 again at the standby position. With the pressing member 29 being raised, the motor 33 is energized to bring the pivotally movable plate 32 of the closure plate 30 upwardly to minimize the area of the closure plate 30. Though the used masters are discharged successively from the feed rollers 21 into the duct 22, these used masters are not prevented from falling into the paper box 27 of the used master box 24. Therefore, it is possible to continuously operate the mimeographic printing apparatus to discharge the successive used masters.

When the paper box 27 is fully filled with the used masters, detection signals of the predetermined pressure by the pressure sensors 38 and also a position signal indicating that the closure plate 30 is disposed at the upper limit of the compression-accommodation section $Z_2$ are inputted to a control means. In other words, when the intermediate position detecting switch MS is off, namely, when the pressing member 29 is located in the standby-convey section $Z_1$, the pressure sensor 38 detects a predetermined pressure. Due to these OFF signals and the pressure detection, the control unit 12 detects that the paper box 27 is fully filled with the used masters, and indicates such message on the operation panel, for example.

Figure 6:
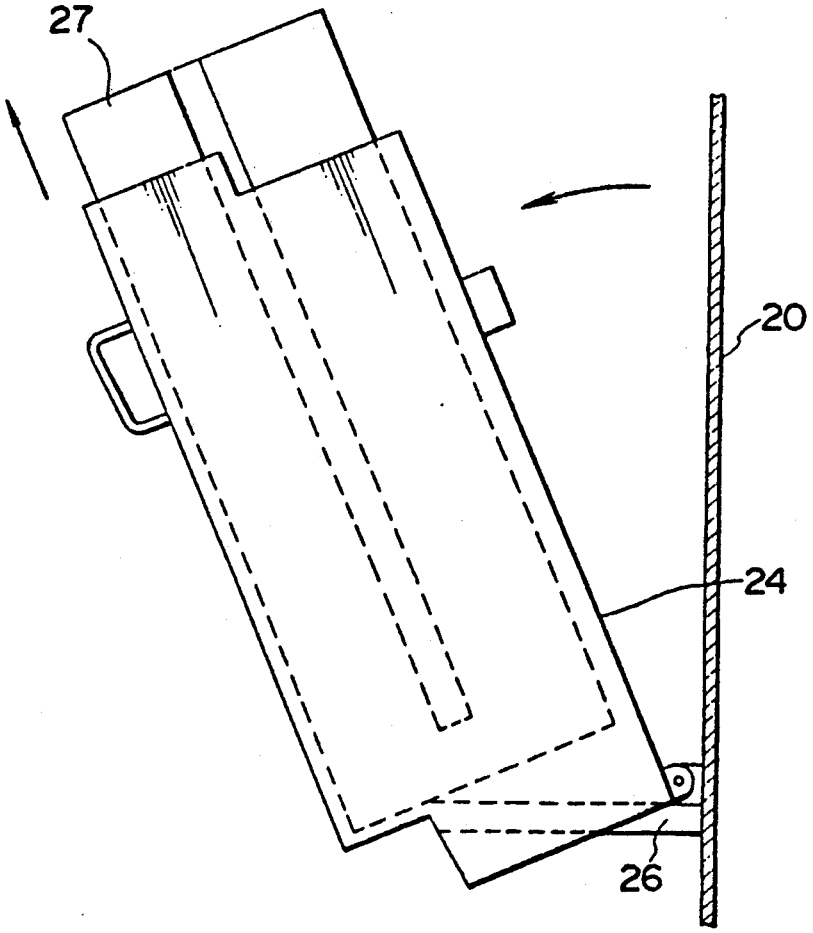
FIG. 6 shows the mode of operation of a receptacle adapted to be mounted on the apparatus.

As shown in FIG. 6, when the used master box 24 magnetically attached to the frame 20 is inclined by pulling toward the operator, the paper box 27 in the used master box 24 is raised by the bottom plate 26 to project exteriorly from the upper open end of the used master box 24. Thus, since the upper end of the paper box 27 is inclined toward the operator to project upwardly, it is easy to take out. Then the paper box 27 filled with the used masters may be taken out for disposal.

In the first embodiment described above, the vertically movable member 51 carrying the motor 57 moves vertically to drive the closure plate 30 vertically. Alternatively, an elongated member may be vertically circularly driven by a motor, and a vertically moving means such as an elevator may be used for moving the closure plate 30 vertically. Further, in the closure plate 30 of the first embodiment, the pivotally movable plate 32 is pivotally movable about a hinge with respect to the vertically movable plate 31; means for varying the area of the plate-like pressing surface should by no means be limited to the foregoing example. For example, the pressing portion of the pressing member may be a slide-type closure plate including a slide plate movable rectilinearly with respect to the vertically movable plate 31. In an alternative form, the closure 30 may be in a single integral plate which is angularly movable as a whole. Also, instead of the pressure sensor 38, a method of detecting in terms of electric current of the motor 57 may be used.

The mode of operation of the master disposing apparatus described above will now be described with reference to FIGS. 7 and 8.

Figure 7:
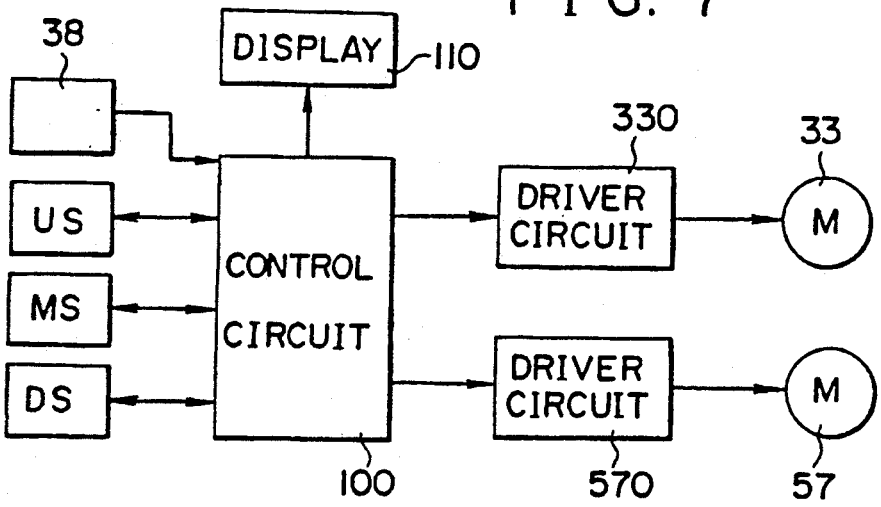
FIG. 7 is a block diagram showing a control system of the first embodiment.
Figure 8:
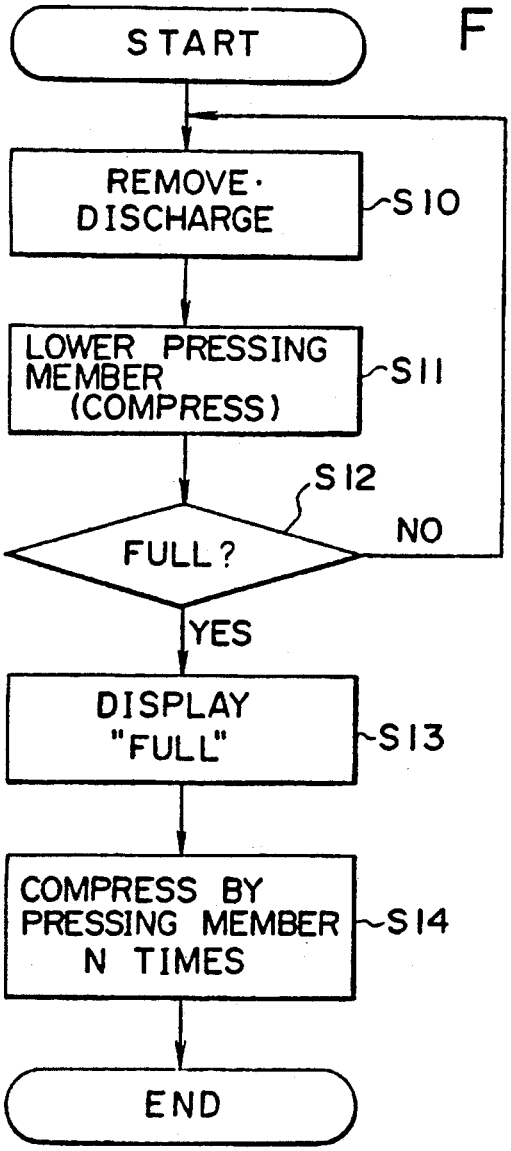
FIG. 8 is a flowchart showing the order of disposing procedures of the first embodiment.

In FIG. 7, reference numeral 100 designates a control circuit serving as a pressing member control means for controlling the pressing member 29 and also as a control unit such as a processor for controlling the entire apparatus; US, MS, DS, position detecting switches as detecting means; 38, pressure sensors as detecting means; 110, a display for displaying that receptacle is fully filled the used masters; 33, a motor for driving the closure plate 30; 330, a driver circuit for the motor 33; 57, a motor for vertically moving the pressing member 29; and 570, a driver circuit for the motor 57.

In the used master disposing apparatus equipped with the control system discussed above, a used master removed from a non-illustrated master drum and conveyed to the feed rollers 21 via a predetermined discharging path is discarded in the paper box 27 via the duct 22 (step S10).

Then, the control unit 100 drives the motor 57 via the driver circuit 570. By the drive of the motor 57, the pressing member 29 is lowered to compress the discarded master (step S11).

If in lowering of the pressing member 29 during compressing, the detection of a predetermined pressure by the pressure sensors 38 is earlier than the detection signal by the intermediate position detecting switch MS, the motor 33 is driven to open the closure plate 30 so that the pressing member 29 is raised and, at the same time, the display 110 displays that the paper box 27 has been fully filled with the discarded plates and gives such notice to the operator (steps S12, S13).

Subsequently as the control unit 100 drives the motor 57 again via the driver circuit 570, the pressing member 29 is lowered to finally compress the master. Now when the pressure sensors 38 attached to the pressing member 29 detect a predetermined pressure, the motor 57 is driven for reverse rotation to raise the pressing member 29 until the position of the pressing member 29 is detected by the upper position detecting switch US. This procedure is then repeated for a predetermined number of times (step S14). This number of times can be determined from a total time necessary for the final compression and also from a compressing time by one procedure.

By this procedure, the compression of the discarded master in the paper box 27, after detected that the paper box 27 has been detected as being fully filled with the discarded masters, can be achieved with absolute perfection.

Figure 9:
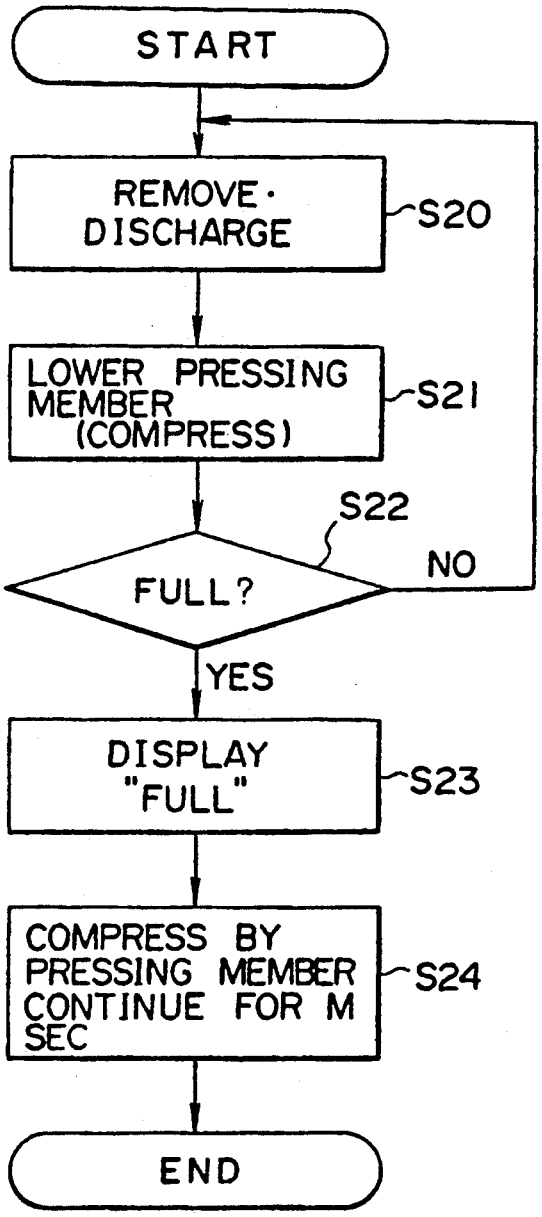
FIG. 9 is a flowchart showing a different order of disposing procedures.

Alternatively, as shown in the flowchart of FIG. 9, when the paper box 27 has been detected as being fully filled with the discharged used masters, it may continue compressing these masters by the pressing member 29 for M seconds. Thus, by presetting a period of time necessary for the final compressing of the masters and by keeping the compressing state with the pressing member 29 for a predetermined period of time, it is possible to secure a stable and perfect compressing procedure. Therefore, even when the paper box 27 is removed from the apparatus, it is possible to prevent the discharged masters from becoming bulky in the paper box 27 to overflow and fall from the paper box 27.

In the foregoing embodiment, the switches are used to detect whether the paper box is fully filled with the used masters. In an alternative form, a counter may be used which counts the number of dischargings of the used masters and then outputs a signal when the counted number reaches a predetermined value, namely, when the paper box is fully filled with the discharged masters.

As is apparent from the description of the first embodiment, according to the master disposing apparatus of this invention, partly since the pressing area of the pressing member decreases when the pressing member is lowered to compress the discharged master, and partly since the pressing area increases, it is possible to compress the discharged master and accommodate it in the receptacle reliably without obstructing the conveying of the used masters successively discharged. Thus as a large number of the discharged masters can be accommodated in the receptacle successively without misconveying, it is possible to elongate the time of continued operation of the printing machine by a large extent.

According to the master disposing apparatus of the first embodiment, when the receptacle has been fully filled with the used masters, the masters in the receptacle are compressed by the pressing member for only a predetermined total period of time for final disposing. Therefore, the used masters in the receptacle can be compressed with perfection so that even when the receptacle is removed from the apparatus, the discharged masters in the receptacle is free from becoming bulky to overflow.

Figure 10:
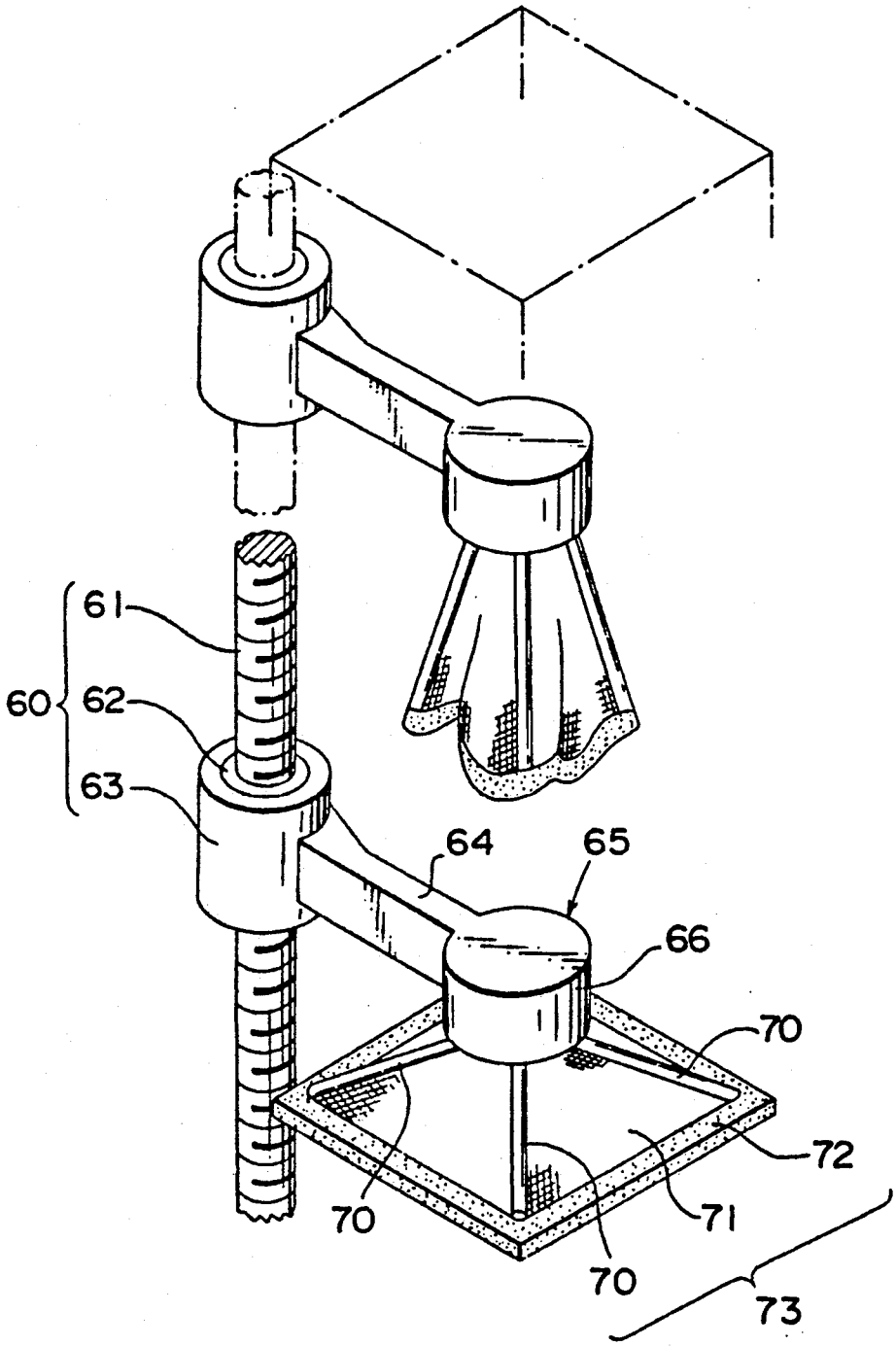
FIG. 10 is a perspective view of a pressing member of a used master proposal apparatus according to a second embodiment of the invention.
Figure 11:
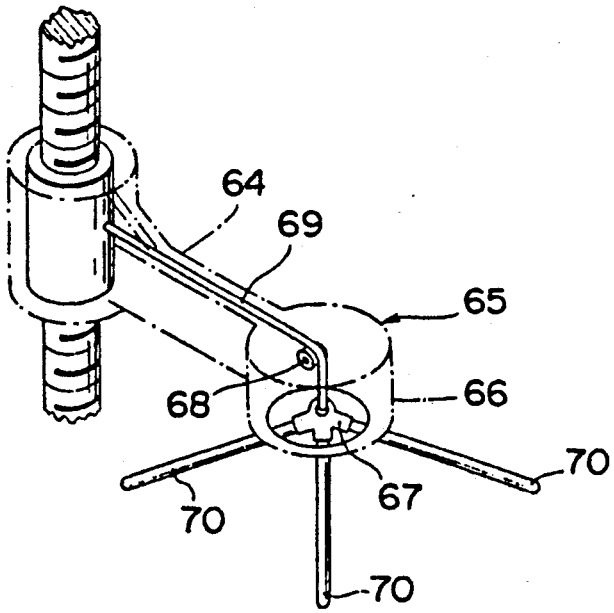
FIG. 11 is a perspective view of the interior structure of the apparatus of FIG. 10.

FIGS. 10 and 11 show a second embodiment of this invention. The vertically moving means and the pressing member which are different in construction from those of the first embodiment will be described here; other parts or components are substantially identical with the corresponding parts of the first embodiment.

A vertically moving means 60 equipped with the used disposing apparatus includes a drive shaft 61 to be driven for rotation by a non-illustrated drive source, and a vertically movable member 63 mounted on the drive shaft 61 via a slip clutch 62. Then, a pressing member 65 is supported on the vertically movable member 63 via a hollow connecting rod 64. A cylindrical base 66 opening at its lower side is secured to the connecting rod 64. Inside the base 66, a flexible member 67 is hung by a wire 69 via a pulley 68. Four rods 70 are attached to the flexible member 67 so as to form four ridgelines of a quadrangular pyramid. And a mesh 71 is put up on the rods 70, and a strip of sponge 72 is attached to and along the lower peripheral edge of the mesh 71 to thereby provide an umbrella-shaped pressing part 73. The wire 69 hanging the flexible member 67 of the pressing part 73 is wound around the slip clutch 62 via the connecting rod 64.

With the arrangement of the second embodiment, when the vertically movable member 63 and the pressing part of the pressing member 65 are lowered as the drive shaft 61 is rotated, the pressing part 73 opens in a quadrangular pyramid as the wire 69 is free from being caught in the slip clutch 62. Reversely, when the vertically movable member 63 and the pressing part 73 are moved upwardly, the flexible member 67 enters the upper portion of the base 66 as the wire 69 is caught in the slip clutch 62. As the pressing part 73 opens in the shape of a quadrangular pyramid, the individual rods 70 are brought in contact with the open lower edge of the base 66. Thus, when the pressing part 73 is lowered to compress the discharged master, the pressing part 73 is widen to increase its area. When the pressing part 73 is raised, its area is reduced so as not to interfere the conveying of the discharged master.

Figure 12:
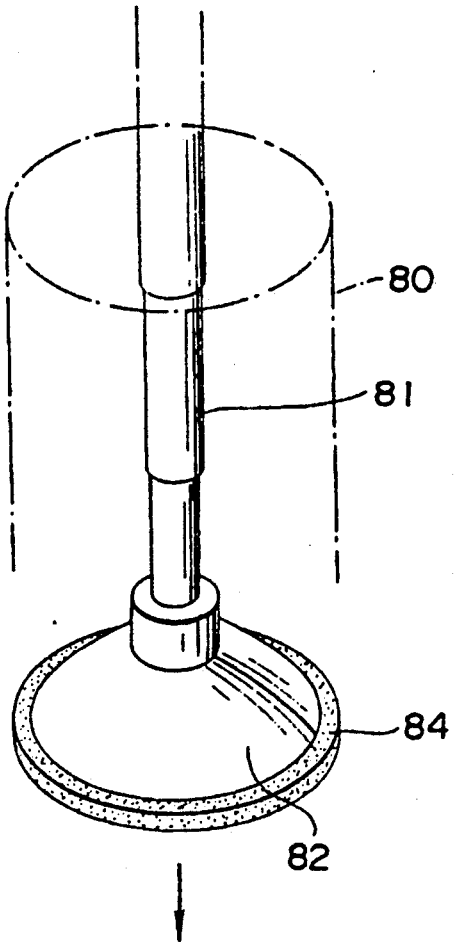
FIG. 12 is a perspective view showing a different pressing member in the form of an air bag according to a third embodiment.
Figure 13:
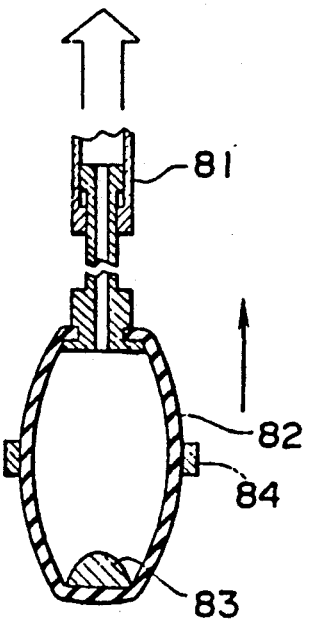
FIG. 13 is a cross-sectional view of the air bag of FIG. 12, showing the air bag having been raised.
Figure 14:
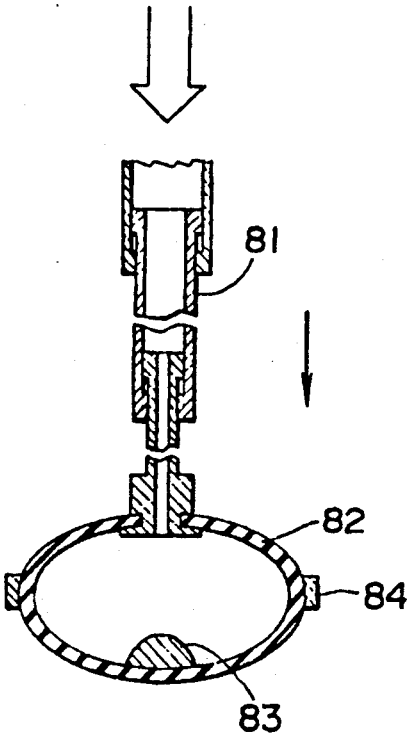
FIG. 14 is a cross-sectional view of the air bag of FIG. 12, showing the air bag having been lowered.
Figure 15:
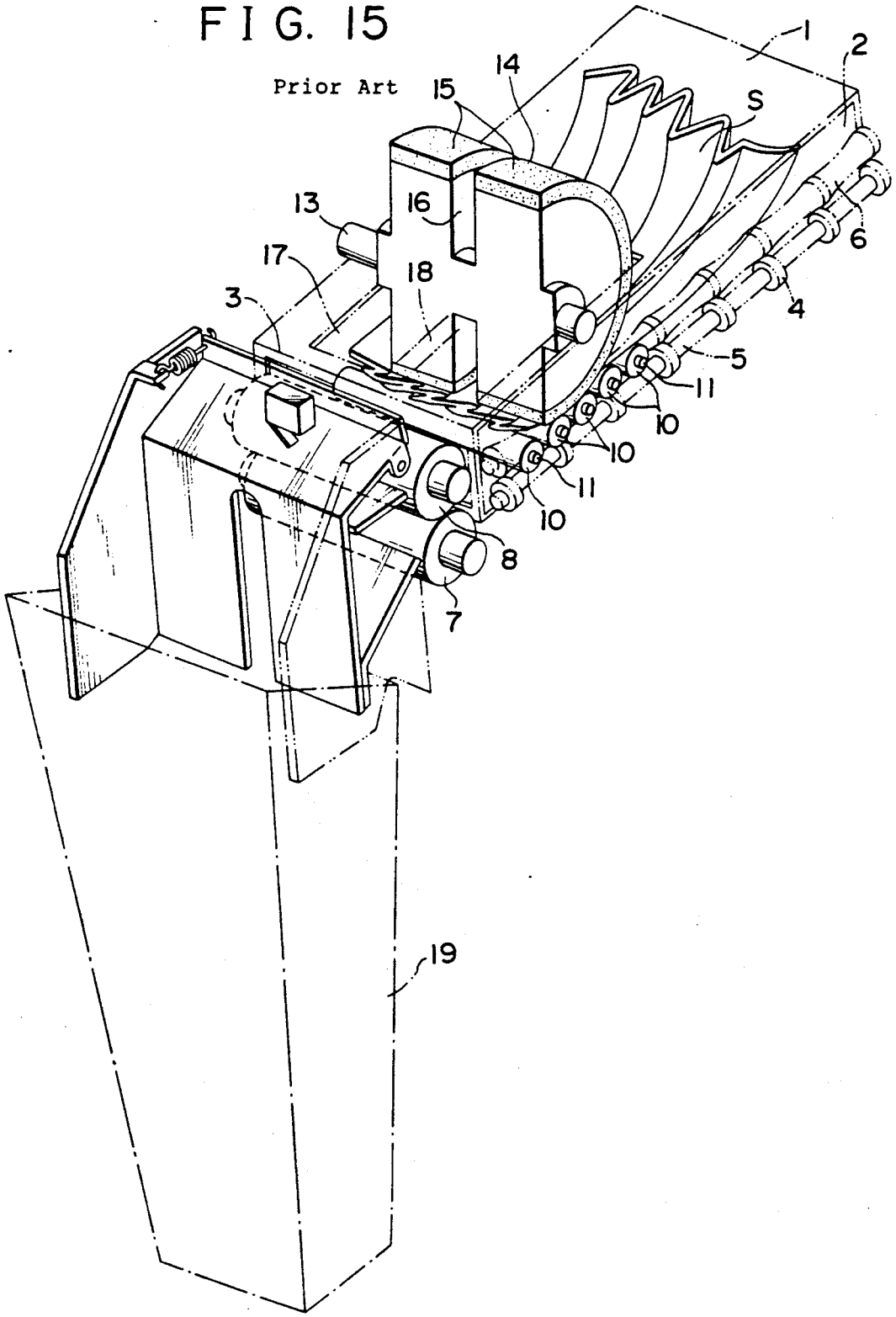
FIG. 15 Prior Art
FIG. 15 is a perspective view showing a master discharge apparatus mounted on a mimeographic printing machine, the apparatus being equipped with a conventional disposal box.

FIGS. 12 through 14 show a third embodiment of this invention. The vertically moving means and the pressing member which are different in construction from those of the first embodiment will be described here;

other parts or components are substantially identical with the corresponding parts of the first embodiment.

Although there is no illustration in the drawings, the vertically moving means of this embodiment is in the form of an air cylinder located above a cylindrical receptacle 80. An air bag 82 serving as the pressing member is mounted on a distal end of the rod of the air cylinder via a telescopically stretchable cylinder 81. The air bag 82 communicates with the air cylinder via the stretchable cylinder 81 and the rod to supply air. A weight 83 is located on the bottom inside the air bag 82, and a strip of sponge 84 is attached to the air bag 82 around the outer circumferential surface thereof.

With this arrangement, if air is forced in the air bag 82 to compress the discharged master, as shown in FIG. 14, the air bag 82 bulges horizontally to assume a spheroid so that as the area of the pressing part is expanded, the cylinder 81 is progressively extended downwardly under the air pressure. If the air in the air bag 82 is drawn, the air bag 82 restores its original vertically elongated contour as shown in FIG. 13 so that as the area of the pressing part is reduced, the cylinder 81 becomes shrunk. Further, the same results as the foregoing embodiments can be achieved. In this embodiment, the pressing member is deformed by introducing air; instead, liquid may be used.

This invention may be embodied in other specific forms without departing from the spirit or essential characteristics thereof. These embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A used master disposing apparatus comprising:

a receptacle for receiving a discharged master;

a pressing member vertically movably mounted in said receptacle, said pressing member being in a form of a plate and including a vertically movable plate and a pivotally movable plate pivotally connected to the vertically movable plate, said pivotally movable plate inclining upward relative to the vertically movable plate in order not to prevent falling of the discharged master into the receptacle when the pressing member moves upwardly, said pivotally movable plate moving downward to be parallel to the vertically movable plate when said pressing member is lowered so that said pressing member compresses the discharged master at a compressing area formed of the vertically and pivotally movable plates substantially corresponding to a horizontal area of the receptacle;

detecting means for detecting whether said receptacle is filled with the discharged masters; and control means for driving said pressing member, said control means, upon receipt of a detection signal from said detecting means, operating in such a manner that said pressing member compresses the discharged master in said receptacle repeatedly for a predetermined period of time necessary for final compressing treatment of the discharged masters.

2. A used master disposed apparatus according to claim 1, wherein said detecting means includes position detecting means for detecting a limit position of said pressing member, and pressure detecting means mounted on said pressing member for detecting a compressing pressure, and wherein upon receipt of a pressure detection signal from said pressure detecting means before receiving a position detection signal from said position detection means, said control means judges that said receptacle is filled with the discharged masters, and said pressing member is driven so as to compress again the discharged master in said receptacle for a predetermined period of time.

3. A used master disposing apparatus according to claim 1, wherein said driving means comprises a vertically movable member situated adjacent to the receptacle parallel thereto, said vertically movable member being connected to the vertically movable plate for moving the same.

4. A used master disposing apparatus according to claim 3, further comprising a frame, said driving means further including a motor attached to the vertically movable member, a pinion attached to the motor, and a rack attached to the frame and engaging the pinion so that when the motor is actuated, the vertical movable member moves up and down.

5. A used master disposing apparatus according to claim 1, wherein said pressing member further includes a motor with a shaft situated on the vertically movable plate, a disk attached to the shaft of the motor, and a link rotatably connected to the pivotally movable plate and the disk so that when the motor is rotated, the pivotally movable plate changes between a horizontal position and an upwardly inclined position.

6. A used master disposing apparatus according to claim 1, wherein said control means actuated the pressing member to move downwardly whenever the discharged master is supplied to the receptacle so that each of the discharged master is compressed.

* * * * *